US006154890A

United States Patent [19]

Deopuria et al.

[11] Patent Number: 6,154,890

[45] Date of Patent: Dec. 5, 2000

[54] ENLARGED EARCUP WITH ADJUSTABLE EARSEAL AND IMPROVED NOISE ATTENUATION

[75] Inventors: John R. Deopuria, Johnson City, N.Y.; Charles A. Westgate, Thompson, Pa.

[73] Assignee: Gentex Corporation, Carbondale, Pa.

[21] Appl. No.: 09/326,434

[22] Filed: Jun. 4, 1999

[51] Int. Cl.[7] ..... A42B 3/16

[52] U.S. Cl. ..... 2/423; 2/209; 2/6.1; 181/129; 381/371; 381/376

[58] Field of Search ..... 2/6.1, 422, 423, 2/209, 6.2, 6.6; 181/129, 137; 381/309, 310, 370, 371, 376

[56] References Cited

U.S. PATENT DOCUMENTS 3,456,263 7/1969 Aileo .
3,875,592 4/1975 Aileo .
4,057,856 11/1977 Aho .
4,572,323 2/1986 Randall ..... 181/129
4,674,134 6/1987 Lundin .
4,700,410 10/1987 Westgate .
4,905,322 3/1990 Aileo et al. .
5,020,163 6/1991 Aileo et al. .
5,148,887 9/1992 Murphy .
5,500,958 3/1996 Falco .
5,581,627 12/1996 Bowser et al. .

*Primary Examiner*—Michael A. Neas
*Attorney, Agent, or Firm*—Shenier & O'Connorr

[57] ABSTRACT

An enlarged earcup which occupies substantially all of the helmet eardome and provides greater attenuation of ambient noise, especially low frequencies. The speaker and earseal are mounted onto an adjustable assembly. The assembly is slideably mounted onto a flange which extends inwardly from the earcup's rim. The assembly includes a pair of parallel annular plates which sandwich the flange therebetween.

16 Claims, 5 Drawing Sheets

ENLARGED EARCUP WITH ADJUSTABLE EARSEAL AND IMPROVED NOISE ATTENUATION

FIELD OF THE INVENTION

The invention relates to a enlarged earcup which occupies a substantial portion of the helmet eardome thereby providing improved noise attenuation. More particularly, it relates to an earcup in which adjustment of the earseal is achieved through sliding movement of an earseal-bearing plate relative to the earcup.

BACKGROUND OF THE INVENTION

Various forms of sound attenuating earcups are known from the prior art for protecting the ear of the wearer from the effects of ambient noise. For example, the crew of rotary wing aircraft are provided with earcups used in combination with protective helmets. The helmets are equipped with an oversized earcup-receiving dome wherein the earcup may be adjustably located to custom fit the wearer. Usually such helmets are equipped with earphones and microphones to allow communication with the wearer. Typically these helmets equipped with earphones must possess the adjustability to fit a specified anthropometric range, yet provide exceptional noise attenuation and adequate communication capabilities.

Previous attempts to fulfill these various objectives may be seen in four prior art patents owned by the assignee of this application. U.S. Pat. No. 3,875,592 discloses a contoured cup surface which compliments the shape of the wearer's head surrounding the ear. The ear seal has a uniform thickness that follows the contour of the cup to provide a highly effective seal with the wearer's head at all points around the ear. U.S. Pat. No. 4,700,410 provides an inflatable bladder between the earcup and helmet to bias the earcup against the wearer's head. U.S. Pat. No. 5,020,163 discloses a resilient annular earseal having an inner preferral portion projecting outwardly toward the wearer's head. While these designs are effective in providing better seals, they do not provide adequate attenuation of ambient noise, particularly in the low frequencies. U.S. Pat. No. 5,148,887 discloses a moveable piston within the earcup which responds to ambient noise impinging on the shell to maintain the internal volume substantially constant. While this patent provides better attenuation of ambient noise, its design along with the inflatable bladder design are complex and therefor expensive to produce.

Accordingly it would be desirable to provide an earcup assembly for use in conjunction with an aircrew helmet which is simple in design, provides improved sound attenuation and communication capabilities and is easily custom fit to individual crew members.

SUMMARY OF THE INVENTION

It is therefore a primary object of the present invention to provide an improved sound attenuating earcup assembly which overcomes the problems of earcup assemblies of the prior art.

Another object of the invention is to provide an enlarged earcup which is more effective at attenuating low frequency ambient noise.

It is a further object of the present invention to maximize the level of low frequency attenuation by having the earcup completely occupy the helmet eardome.

It is another object of the present invention to provide a high level of flexibility in positioning the ear seal to custom fit individual crew members.

It is also an object of the present invention to easily secure the earseal while automatically maintaining communication component alignment.

These and other related objects are achieved according to the invention by providing an earseal which is adjustable with respect to the earcup rather than affixed thereto. Since positioning the earcup itself is no longer critical, we provide an enlarged earcup which substantially fills the helmet earcup-receiving dome. The larger internal volume of the earcup is significantly more effective at attenuating ambient noise, particularly low frequencies. The speaker is coupled to the earseal assembly to maintain alignment therewith upon adjustment of the earseal.

BRIEF DESCRIPTION OF THE DRAWINGS

In the accompanying drawings to which reference is made in the instance specification and which are to be read in conjunction therewith and which like reference characters are used to indicate like parts in the various views.

DETAILED DESCRIPTION OF THE PREFERRED EMBODIMENT

Sound attenuating earcups of the prior art incorporate a relatively rigid shell surrounding the wearer's ear. The earcups are received within eardomes formed on either side of a protective helmet. The periphery of the shell carries a resilient earseal so supported to engage the portion of the wearer's head around his ear. The earcup is removably attached to the enlarged helmet eardome with spacer pads providing adjustment along three orthogonal axes.

Figure 1:
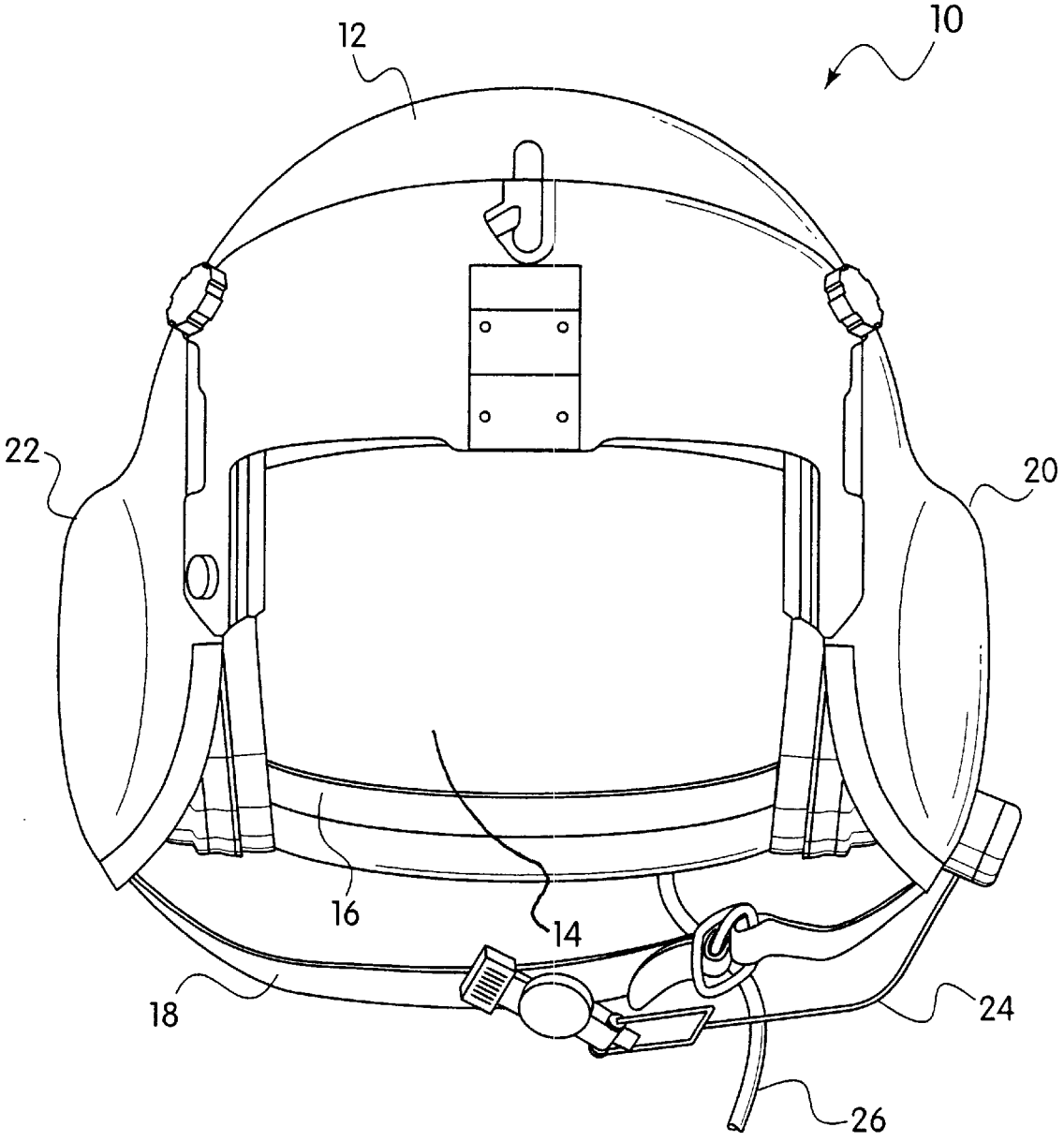
FIG. 1 is a front elevational view of a helmet according to the prior art having earcup-receiving domes for mounting protective earcups therein.

Referring now to the drawing, and in particular to FIG. 1, our earcup assembly is adapted to be incorporated into a protective helmet worn by crew members of rotary wing aircraft, such helmet is indicated generally by reference number 10. The helmet includes an outer hard shell 12 and a liner 14 made of an energy absorbing material. The helmet is provided with a nape strap 16 and a chin strap 18. The earcups are placed within openings formed within liner 14 and are supported by a left hand earcup support 20 and a right hand earcup support 22. Earcup supports 20 and 22 are integrally formed as part of helmet 10. A mic boom 24 and speakers located within each earcup are electrically coupled to an external audio interface via communications cable 26. Shell 12 may comprise any hard suitable material, such as fiberglass or a laminate of resin-impregnated layers of aramid cloth sold under the trademark KEVLAR.

Figure 2B:
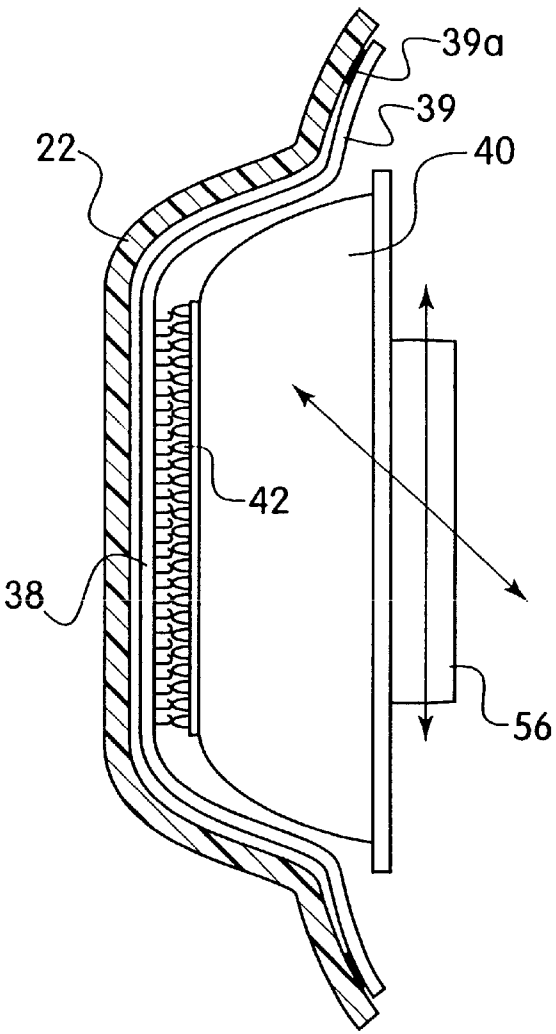
FIG. 2B is a cross sectional view of the same helmet eardome showing the enlarged earcup according to the invention occupying the entire eardome.
Figure 2A:
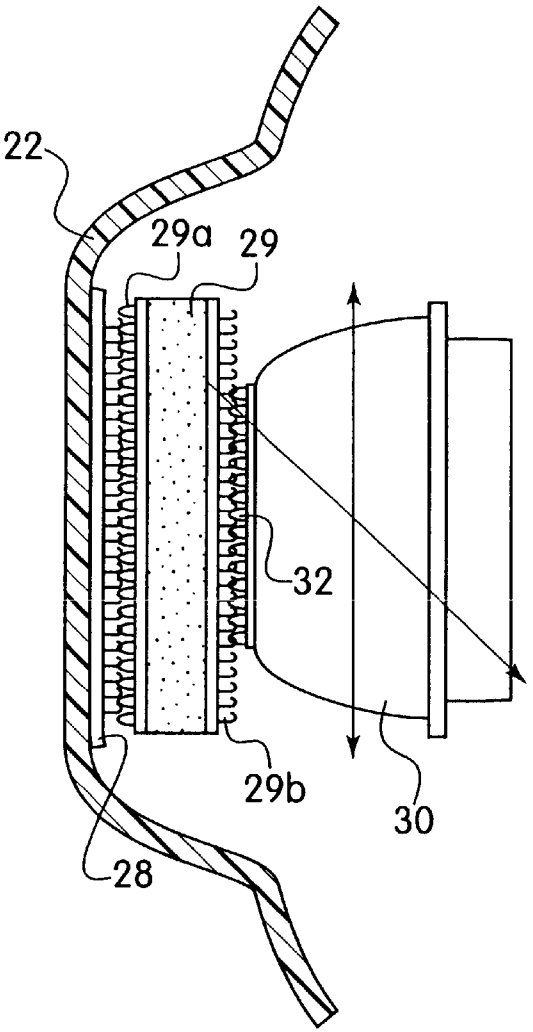
Fig. 2A (Prior Art)
FIG. 2A is a cross sectional view of one helmet eardome showing two dimensional adjustability for attaching the earcup.

FIGS. 2A and 2B show the interior of right hand earcup support 22, it being understood that the left hand earcup support is similarly configured. FIG. 2A illustrates the prior art wherein right hand earcup support 22 carries on its inner surface a strip of hook-type fastening material 28, such as that sold under the trademark VELCRO. Fastening material 28 may adhere directly to loop-type fastening material 32 or through one or more foam spacer pads 29 which may be provided in different thicknesses. Spacer pad 29 carries complimentary strips of loop-type fastening material 29*a* and hook-type fastening material 29*b*. The double ended arrows illustrated on earcup shell 30 represent x–y axes along which shell 30 can be adjusted before being adhered to support 22.

Earcup support 22 is oversized in two dimensions to permit adjustable positioning of earcup 30 up and down as well as front and back. A typical problem with earcups according to prior art is their limited effectiveness at attenuating low frequency noise, for example, frequencies less than 2000 Hz which are particularly prevalent within rotary wing aircraft. We have discovered that as the internal volume of the earcup shell increases greater attenuation is provided for low frequency noise. However, as the external dimensions of the earcup increase, the degree of flexibility in locating the earcup within the earcup support is diminished. We have further discovered a way to maximize the internal volume of the earcup so that it occupies the entire earcup support and still provide adjustability within the required fitting range.

FIG. 2B shows a hook-type fastening material 38 for securing the loop-type fastener 42 of earcup shell 40 according to the invention within earcup support 22. Alternatively the hook-type material may be located on shell 40 with the loop-type material placed within elastic 39. Surrounding hook-type fastening material 38 is a circular strip of elastic material 39 which is attached to the interior of the helmet shell 12 by a circular bead of adhesive 39*a*. Elastic material 39 acts as a spring or a trampoline ordinarily suspending hook-type fastening material 38 across the earcup support in the same plane as the adhesive bonds 39*a*. In use earcup shell 40 is displaced by the wearer's head into earcup support 22 against the restoring force of elastic 39. When donning the helmet, earseal 56 is slideable along the x and y axes as indicated by the intersecting double ended arrows. The sliding connection between ear seal 56 and earcup shell 40 will be described in greater detail below.

Figure 3:
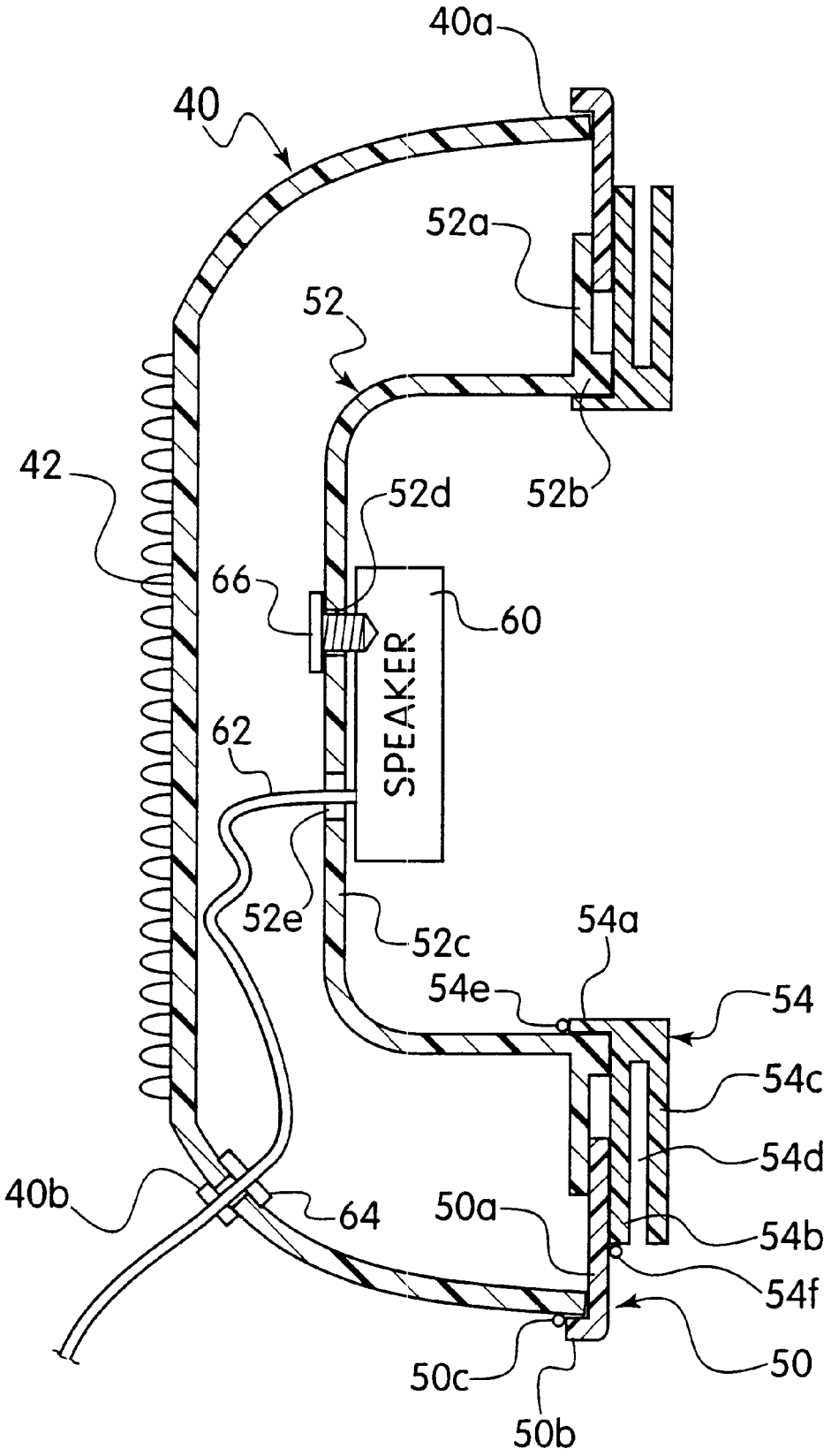
FIG. 3 is a cross sectional view of the enlarged helmet earcup according to the invention.
Figure 4:
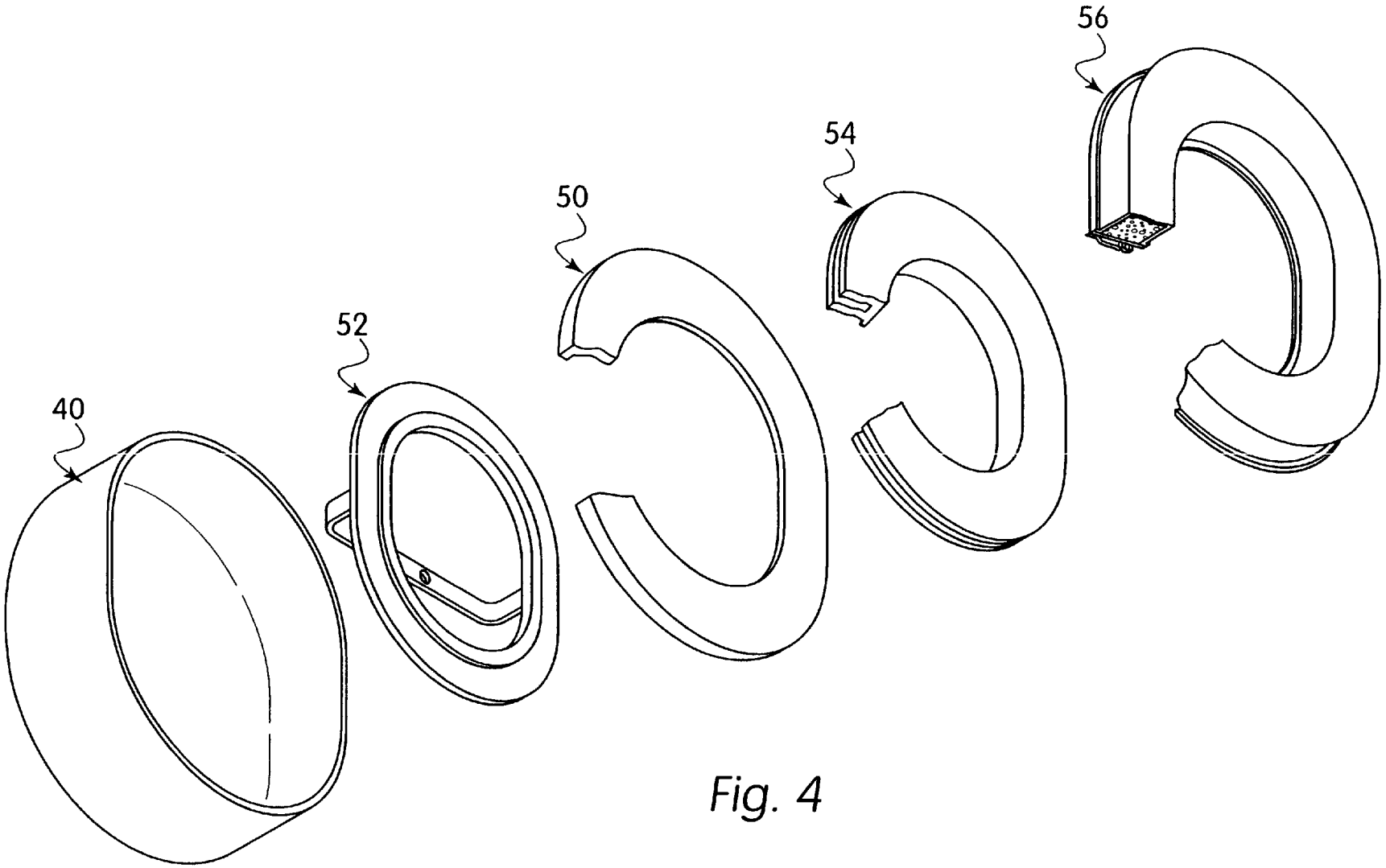
FIG. 4 is an exploded view of the earcup assembly showing the major components thereof.

FIGS. 3 and 4 show the major components of the sliding connection with earcup shell 40 shown on the left side of the figure and ear seal 56 shown on the right hand side of FIG. 4 only. Shell 40, flange 50 and plates 52 and 54 are formed of any suitable rigid material, such for example as acrylonitrile-butadiene-styrene (ABS) copolymer. Earcup shell 40 includes a rim 40*a* defining the earcup shell opening. At the closed end of shell 40 a shell aperture 40*b* is provided and a loop-type fastening material 42 extends across the rear surface thereof.

Attached to rim 40*a* is a flange 50 which includes a flat annular portion 50*a* and a rim portion 50*b* which is adhered to rim 40*a* by a first bead of adhesive 50*c*. Before attaching flange 50 to earcup shell 40, slider plate 52 and ear seal retainer plate 54 are attached together through the central opening in flange 50. More particularly slider plate 52 includes a flat annular portion 52*a* which is disposed parallel and in contact with the inner side of annular portion 50*a* of flange 50. Rim portion 52*b* extends outwardly and has a dimension which is slightly thicker than flat annular portion 50*a*. A bridge 52*c* spans flat annular portion 52*a* in the direction of its major axis. Bridge 52 is displaced rearwardly from flat annular portion 52*a* to reside within shell 40.

Earseal retainer plate 54 includes an inner edge 54*a* which fits within rim portion 52*b* and is secured thereto by a second bead of adhesive 54*e*. A first annular portion 54*b* cooperates with flat annular portion 52*a* to slidingly and frictionally engage flat annular portion 50*a* sandwiched there between. The spacing between portion 52*a* and 54*b* being determined by the dimension of rim portion 52*b* as discussed above. Alternatively, rim portion 52*b* may be carried by retainer plate 54 with inner edge 54*a* carried by slider plate 52. Furthermore, flange 50 could be constructed with two spaced, parallel annular portions for frictionally engaging an annular portion of the central sliding construction. Ear seal retainer plate 54 includes a second annular portion 54*c* which is parallel to and spaced from first annular portion 54*b* by an annular gap 54*d*. Structures 54*c* and 54*d* are provided to removably attach ear seal 56 to the earcup assembly, in a manner which will be discussed in greater detail below. Then, with speaker wire 62 extending through a rear portion of earcup shell 40 the sliding assembly consisting of flange 50, slider plate 52 and ear seal retainer plate 54 may be attached to earcup shell 40.

Components 40, 50, 52, 54 and 56 are of similar oval shape with slider plate 52 and earseal retainer plate 54 having slightly smaller dimensions than flange 50. FIG. 3 shows that the plane defined by rim 40*a* contains a nested configuration of the three main components 50, 52 and 54 which comprise the sliding assembly. The outermost component is annular portion 50*a* with rim portion 52*b* nested radially inwardly of annular portion 50*a* and inner edge 54*a* nested radially inwardly of portion 52*b*. Movement of the sliding assembly is limited by rim portion 52*b* contacting the inner radial edge of annular portion 50*a*. For example, the sliding assembly has 0.4" of available vertical movement, 0.4" of available lateral movement. The assembly also possesses rotational movement wherein oval rim 52*b* may be rotated up to 35° before contacting the larger oval of annuar portion 50*a*.

Figure 5A:
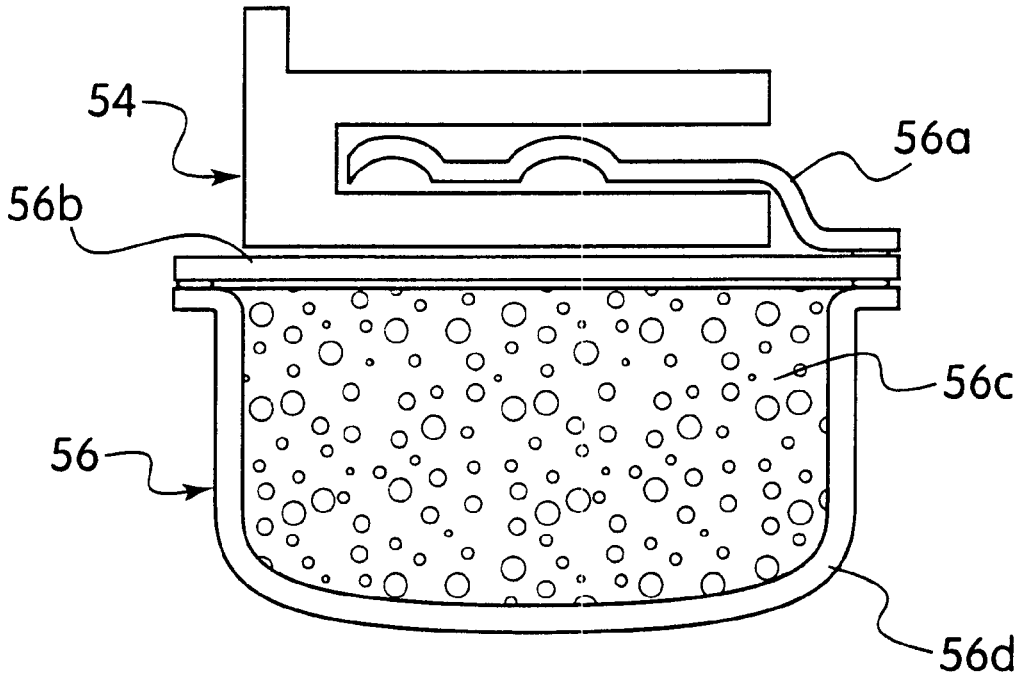
FIGS. 5A & 5B are cross sectional views of two embodiments of the earseal according to the invention.

FIGS. 4 and 5A show earseal 56 which includes a retaining band 56*a* secured at one end to a back cover 56*b*. A foam material 56*c* is disposed within an outer cover 56*d* which is secured along its inner and outer periphery to back cover 56*d*. The free end of retaining band 56*a* is stretched outwardly toward the fixed end and stretched over second annular portion 54*c* into annular gap 54*d*. FIG. 5A shows retaining band 56*a* in its installed position wherein 56 is biased against second annular portion 54*c* as retaining band 56*a* exerts a restoring force towards its resting position, shown in FIG. 5B.

Figure 5B:
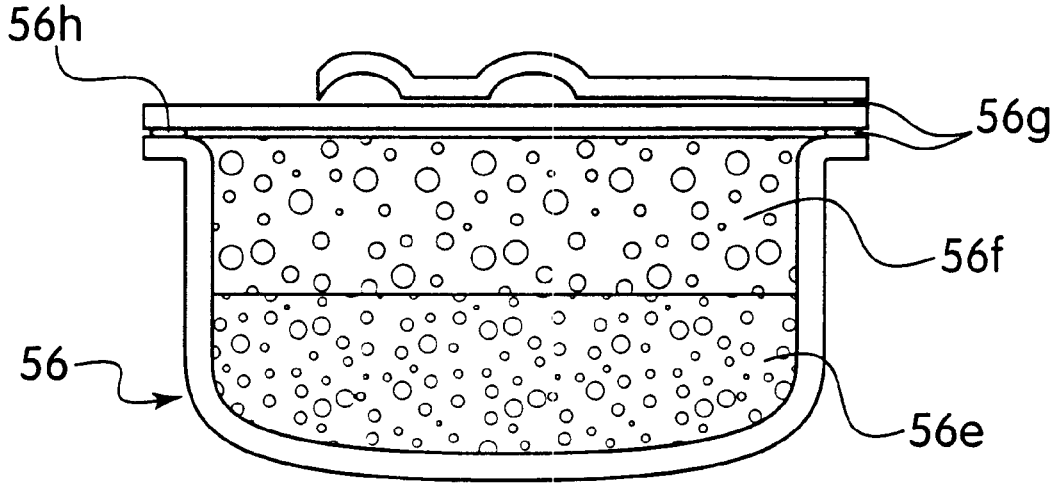

In FIG. 5A the earseal contains a ring of foam material 56*c* which maybe one half inch EPOM foam rubber which is a closed cell material, one half inch pink urethane foam, one half inch polyurethane foam or other suitable materials. FIG. 5B shows ear seal 56 as containing superimposed layers of urethane foam 56*e* and 56*f*. For example, first foam material 56*e* is a quarter inch polyurethane foam or equivalent material and second foam material 56*f* is one quarter inch pink urethane foam or equivalent. In both embodiments the foam is encased within polyfilm having a thickness of 0.017 inches plus or minus 0.002 inches, for example. Outer cover 56*d* is preformed into the shape shown in FIG. 5A and 5B and is bonded 56*g* to back cover 56*b* along the inner periphery and bonded 56*h* to back cover 56*b* and retaining band 56*a* along the outer periphery thermally or ultrasonically. Pierced vent holes are formed at regular intervals about outer cover 56*d* to vent the interior of earseal 56 to allow air to escape from the interior in response to external pressure. For example, three vent holes may be provided on the front and back, each being 1/32 inches in diameter plus or minus 1/64 inches.

FIG. 2B shows earcup shell 40 installed within earcup support 22 such that possible movement of the shell along the x–y axis is minimal. Flange 50 which is secured to shell 40 also remains stationary. In custom fitting a crewman, slider plate 52, earseal retainer plate 54 and earseal 56 are moved as a unitary structure in comfortably placing earseal 56 around the wearer's ear. Once adjusted a third bead of adhesive 54*f* is placed along the outer periphery of first annular portion 54*b* where it contacts flat annular portion 54*a*. This adhesive bead 54*f* eliminates the sliding movement between earseal retainer plate 54 and flange 50.

As you can see we have accomplished the objects of our invention. Our earcup shell effectively occupies the entire earcup support thereby providing increased attenuation, especially of low frequency noise. The earcup shell is easily installed onto a flexible panel without requiring additional spacer pad. The flexible panel stretches outwardly along the z axis, thereby compressing the earseal against the wearer's head in the region surrounding the ear. Finally, through a sliding assembly that includes a speaker within the interior of the earcup, the earseal may be comfortably positioned along the x and y axis. Once positioned, the sliding assembly is fixed in place by a bead of adhesive. The sliding assembly which moves as a unitary structure insures that the speaker maintains alignment with the wearer's ear canal throughout the range of sliding motion.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. An adjustable earcup for placement within an earcup-receiving dome of a protective helmet including in combination:

a rigid, cup-shaped shell having a rim defining an open end adapted to face a wearer's ear and a flange attached to said rim; and adjusting means slidably mounted on said flange for movement along two orthogonal axes, an earseal, and means securing said earseal to said adjusting means.

2. The earcup of claim 1, wherein said shell has a shape and size which substantially fills the entire earcup-receiving dome such that possible movement of the shell along said axes is minimal.

3. The earcup of claim 1, comprising means for removably attaching said shell to said earcup-receiving dome.

4. The earcup of claim 3, wherein said attaching means comprises a hook and loop fastener.

5. The earcup of claim 1, wherein said flange comprises an annular portion which extends inwardly from said rim.

6. The earcup of claim 1, including means comprising a bead of adhesive disposed adjacent said rim for adhering said flange to said rim.

7. The earcup of claim 1, further comprising a bracket disposed within said shell and coupled to said adjusting means, and an earphone speaker attached to said bracket.

8. The earcup of claim 7, wherein said speaker is positioned on said bracket to face a center of said earseal so that upon sliding of said adjusting means to properly position said earseal around a wearer's ear, said speaker is adapted to be generally aligned with a wearer's ear canal.

9. The earcup of claim 5, wherein said adjusting means comprises a pair of outwardly-extending annular portions which cooperatively sandwich said flange therebetween.

10. The earcup of claim 9, wherein said pair of annular portions are parallel to each other.

11. The earcup of claim 9, including means comprising a bead of adhesive for adhering said pair of annular portions to each other.

12. The earcup of claim 9, comprising an earseal retaining plate coupled to said adjusting means.

13. The earcup of claim 12, wherein said earseal retaining plate is parallel to and spaced from said pair of annular portions.

14. The earcup of claim 12, wherein said earseal includes a resilient inwardly-facing annular flap which envelopes said earseal retaining plate.

15. The earcup of claim 8, including means comprising a bead of adhesive for adhering said adjusting means to said flange following adjustment of the earseal into a proper position.

16. The earcup of claim 1, wherein the two orthogonal axes of adjustment are both substantially perpendicular to a wearer's ear canal.

* * * * *